US005531659A

United States Patent [19]

Fusada

[11] Patent Number: 5,531,659

[45] Date of Patent: Jul. 2, 1996

[54] ROLL CASTER SHELL FOR USE IN A CONTINUOUS SHEET CASTING MACHINE

[75] Inventor: Tamotsu Fusada, Fujisawa, Japan

[73] Assignee: Kanto Special Steel Works, Ltd., Kanagawa, Japan

[21] Appl. No.: 388,446

[22] Filed: Feb. 14, 1995

[30] Foreign Application Priority Data

May 18, 1994 [JP] Japan ..... 6-104123

[51] Int. Cl.[6] ..... C22C 38/30; B22C 11/06

[52] U.S. Cl. ..... 492/48; 420/107; 164/428; 164/429

[58] Field of Search ..... 164/448, 428, 164/429, 443, 480, 429; 492/48, 58; 148/335; 420/107, 109

[56] References Cited

U.S. PATENT DOCUMENTS

| | | | |
|---|---|---|---|
| Re. 28,523 | 8/1975 | Hill et al. | 420/107 |
| 3,530,703 | 6/1966 | Shimegi et al. | 420/107 |
| 4,409,027 | 10/1983 | Cordea et al. . | |
| 4,802,528 | 2/1989 | Terrasse et al. . | |
| 4,861,549 | 8/1989 | Khare . | |
| 4,919,735 | 4/1990 | Khare | 148/335 |

FOREIGN PATENT DOCUMENTS

| | | | |
|---|---|---|---|
| 0087482 | 9/1983 | European Pat. Off. . | |
| 3525905 | 1/1986 | Germany . | |
| 58-123859 | 7/1983 | Japan | 420/107 |
| 58-123860 | 7/1983 | Japan | 420/107 |
| 61-159552 | 7/1986 | Japan | 492/58 |
| 92011959 | 7/1992 | WIPO | 164/428 |

*Primary Examiner*—Jack W. Lavinder
*Assistant Examiner*—Randolph S. Herrick
*Attorney, Agent, or Firm*—Sughrue, Mion, Zinn, Macpeak & Seas

[57] ABSTRACT

A roll caster shell for use in a continuous sheet casting machine which is made of an alloy which consists essentially of, in weight %,:

C: 0.35–0.55%, Si: 0.10–0.50%, Mn: 0.20–0.70%,

P: 0.03% or less, S: 0.02% or less, Ni: 0.60% or less,

Cr: 0.80–1.50%, Mo: 0.80–1.50%, V: 0.30–0.60%,

Co: 0.30–1.00%,

Fe and incidental impurities: balance with the total amount of elements other than Fe and C not exceeding 5.0 atomic %.

14 Claims, 1 Drawing Sheet

ROLL CASTER SHELL FOR USE IN A CONTINUOUS SHEET CASTING MACHINE

BACKGROUND OF THE INVENTION

The present invention relates to a roll caster shell for use in a continuous sheet casting machine.

Continuous casting of the twin-roll type is a process in which a molten metal is poured directly into the gap between a pair of rolls which rotate in opposite directions from each other so as to produce a sheet with a thickness of 0.5–10 mm. Since this process can result in savings in manufacturing steps and equipment and has a possibility of creating a new product, the twin-roll type continuous casting process has been widely used in the manufacture of thin aluminum sheets. Because of its advantages, many efforts have recently been made to apply such a process to the manufacture of steel sheets as well.

To elucidate the basic idea, two-roll type continuous casting process will be described in detail with reference to aluminum casting.

FIG. 1 is a schematic illustration of the twin-roll type continuous casting process in which a pair of rolls 10, 10 having a water-cooled double-walled structure is usually employed in order to promote solidification of the molten metal 12 poured into the roll gap through a header 14. Casting nozzle 15, 15 form a guide to the roll gap. Each roll 10 comprises a shell portion 16 which directly contacts the molten metal and a core portion 18 which has a groove 20 formed in its outer surface as a passage for cooling water 22. The roll 10 is assembled by shrink-fitting the shell 16 onto the core 18 or by connecting the shell and core with screws after inserting the core 18 into the shell 16.

During casting, the roll shell is alternately subjected to heating by molten metal and then cooling by cooling water, resulting in formation of heat cracks due to thermal fatigue on the surface of the shell. Thus, the shell must be machined to remove surface cracks when the heat cracks on the surface of the shell become so severe as to damage the surface quality of the cast sheets. This results in additional labor and material costs.

Thus, the material of the roll shell must have an improved resistance to heat cracking. Furthermore, such a material must have excellent thermal conductivity. When a material of low conductivity is used to manufacture a roll shell, productivity is lower because the casting speed must be lowered since solidification of a molten metal within a roll gap is slower.

As is well known, the thermal conductivity of steel degrades as the content of alloying elements increases, so a roll shell for use in continuous casting must be made of a material which has a relatively small amount of alloying elements and exhibits improved resistance to heat cracking during casting.

Conventional materials include:

(i) A steel material having an alloy composition which consists essentially of 0.53–0.58% of C, 0.20–0.30% of Si, 0.45–0.65% of Mn, 0.02% or less of P, 0.02% or less of S, 0.40–0.50% of Ni, 1.0–1.2% of Cr, 0.45–0.55% of Mo, 0.10–0.15% of V, and a balance of Fe and incidental impurities. This steel will be referred to as Conventional Steel I.

(ii) A steel material disclosed in U.S. Pat. No. 4,409,027, which consists essentially of 0.53–0.58% of C, 0.10–0.20% of Si, 0.40–0.70% of Mn, 0.02% or less of P, 0.02% or less of S, 0.45–0.55% of Ni, 1.90–2.30% of Cr, 0.9–1.1% of Mo, 0.30–0.35% of V, and a balance of Fe and incidental impurities. This steel will be referred to as Conventional Steel II.

(iii) An alloy steel disclosed in a French reference "Steels for aluminum continuous caster shells", Bull Cercle Etud Metaux, Vol. 15, No. 10 '85, which consists of 0.32% of C, 0.5% of Mn, 0.3% of Ni, 3% of Cr, 1% of Mo, 0.2% of V, and a balance of Fe and incidental impurities. This alloy steel will be referred to as Conventional Steel III.

Due to an increasing casting speed and a decrease of thickness of aluminum sheet, both of which have recently been in demand, a roll shell with more improved resistance to heat cracking and higher thermal conductivity than these conventional materials is greatly needed.

SUMMARY OF THE INVENTION

The general object of the present invention is to provide a roll caster shell for use in a twin-roll type continuous sheet casting machine, which exhibits high thermal conductivity and excellent resistance to heat cracking.

A specific object of the present invention is to provide a roll caster shell for use in a twin-roll type continuous thin-sheet casting machine, which can exhibit a tensile strength of 1500 MPa or more and a 0.2% yield strength of 1400 Mpa or more at room temperature, a tensile strength at 600° C. of 850 MPa or more and a 0.2% yield strength of 700 MPa or more at 600° C., and a thermal conductivity of 40 W/m.K or more.

It was found by the inventor after studying various kinds of alloy steels including the before-mentioned Conventional Steels I, II, and III that the addition of 0.30–1.00% of Co to an alloy steel comprising 0.80–1.50% of Cr, 0.80–1.50% of Mo, and 0.30–0.60% of V could achieve the above-mentioned target values of both mechanical properties and thermal conductivity.

Thus, the present invention is a roll shell for use in a twin-roll type continuous sheet casting machine which is made of an alloy which consists essentially of, in weight %,:

C: 0.35–0.55%, Si: 0.10–0.50%, Mn: 0.20–0.70%,

P: 0.03% or less, S: 0.02% or less, Ni: 0.60% or less,

Cr: 0.80–1.50%, Mo: 0.80–1.50%, V : 0.30–0.60%,

Co: 0.30–1.00%,

Fe and incidental impurities: balance with the total amount of elements other than Fe and C not exceeding 5.0 atomic %.

DESCRIPTION OF THE PREFERRED EMBODIMENTS

Figure 1:
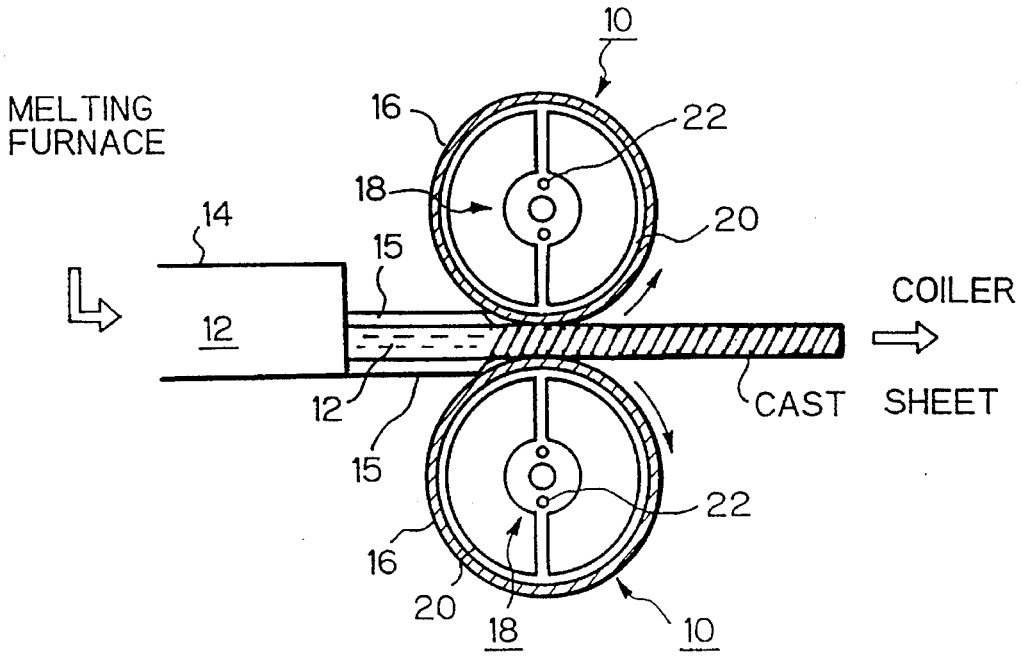
FIG. 1 is a schematic illustration of a twin-roll type continuous sheet casting machine.

According to the present invention the alloy composition is defined as above for the following reasons:

Heat cracks are caused by cyclic compressive and tensile stresses which are produced when the shell surface is subjected to repeated heating and cooling while the temperature of the inner portion thereof is kept almost constant by cooling water.

An alloy steel containing a relatively small amount of alloying elements, such as the alloy steel of the present invention, has substantially the same thermal expansion coefficient regardless of alloy composition, and the above-mentioned stresses produced during cyclic heating are substantially the same for all such alloy steels. The difference of the amount of plastic strain, corresponding to the amount of excessive compression stress which exceeds the yield strength of each material, will mainly affect the resistance to heat cracking.

Namely, it can be said that the yield strength at elevated temperatures has a close relationship with the resistance to thermal cracking of a material.

From the viewpoint of improving elevated temperature yield strength, the alloy composition of the present invention is defined as follows. In the present specification, percents which define alloy composition are by weight unless otherwise indicated.

C: 0.35–0.55%

When the carbon content is smaller than 0.35%, a sufficient level of hardenability cannot be obtained, resulting in an insufficient level of hardness. On the other hand, when it is over 0.55%, an excess amount of carbides precipitates and both the resistance to thermal cracking and the toughness are degraded. Preferably, the carbon content is 0.45–0.50%.

Si: 0.10–0.50%

Si is added as a deoxidizing agent and also as a promoter of hardenability in an amount of 0.10% or higher. The upper limit is defined as 0.50%, since an excess amount of Si markedly degrades toughness as well as thermal conductivity. A preferred Si content is 0.15–0.30%.

Mn: 0.20–0.70%

The addition of Mn, like Si, is effective to promote deoxidizing and hardenability when it is added in an amount of 0.20% or more. The upper limit is restricted to 0.70%, since excessive addition thereof reduces the cleanness of the resulting alloy steel. Preferably, the Mn content is 0.35–0.55%.

P: 0.03% or less, S: 0.02% or less

In order to ensure a sufficient level of thermal cracking resistance and toughness, the contents of P and S are restricted to 0.03% or less and 0.02% or less, respectively.

Ni: 0.60% or less

Ni can be added to the alloy steel of the present invention so as to improve hardenability. However, when Ni is added excessively, residual austenite is formed in a quenched steel, resulting in a degradation in toughness after tempering. Therefore, the upper limit is restricted to 0.60%. Preferably, the Ni content is restricted to 0.40% or less.

Cr: 0.80–1.50%

In order to ensure a sufficient level of hardenability and strength, 0.80% or more of Cr is added. When Cr in an amount of more than 1.50% is added, the resistance to softening after tempering is reduced and the thermal conductivity is degraded. Preferred Cr content is 1.0–1.2%.

Mo: 0.80–1.50%

The addition of Mo is markedly effective for improving hardenability and elevated temperature strength. When the Mo content is smaller than 0.80%, it is difficult to achieve a tensile strength at 600° C. of larger than 800 MPa. Thus, the lower limit of the Mo content is defined as 0.80%. On the other hand, since Mo is an expensive element and excess addition of Mo results in a degradation in toughness, the upper limit is defined as 1.50% so as to improve economy as well as to avoid a deterioration in toughness. Preferably, the Mo content is 1.0–1.2%.

V: 0.30–0.60%

V in an amount of 0.30% or more is added so as to obtain a marked level of resistance to softening after tempering and elevated temperature strength. When the V content is smaller than 0.30%, it is difficult to achieve elevated temperature strength at 600° C. of 850 MPa or more and a 0.2% yield strength at 600° C. of 700 MPa or more. On the other hand, excessive addition of V results in a degradation in toughness, and the upper limit thereof is defined as 0.60%. A preferable V content is 0.40–0.60%.

Co: 0.30–1.00%

The addition of Co is one of the most important features of the present invention. The addition of Co in an amount of 0.30% or more is effective for further improving the softening resistance after tempering and elevated temperature strength, the combination of which results in an improvement in the resistance to thermal cracking. Excessive addition thereof reduces hardenability as well as toughness, and the upper limit of the Co content is defined as 1.00%. Preferably the Co content is restricted to 0.40–0.60%.

As already mentioned, in a preferred embodiment of the present invention, the total content of alloying elements other than Fe and C is restricted to 5.0 atomic % or less. The reasons for this limit are as follows.

A roll caster shell for use in a twin-roll type continuous casting machine has the function of removing heat from a molten metal cast into a roll gap to promote solidification by means of water cooling from the inside. Thus, when the thermal conductivity of the roll shell is small, enough heat cannot be removed from the cast molten metal and its solidification is delayed, resulting in difficulties in performing normal casting operation. Therefore, it is necessary to slow down the casting rate until a smooth casting operation can be recovered. This means that employment of a roll shell having a low thermal conductivity results in a decrease in productivity of the casting machine.

It is to be noted that in order to improve the resistance to thermal cracking, it is preferable to add the before-mentioned various alloying elements, but addition of such elements in large amounts results in deterioration in thermal conductivity in such an alloy steel.

Figure 2:
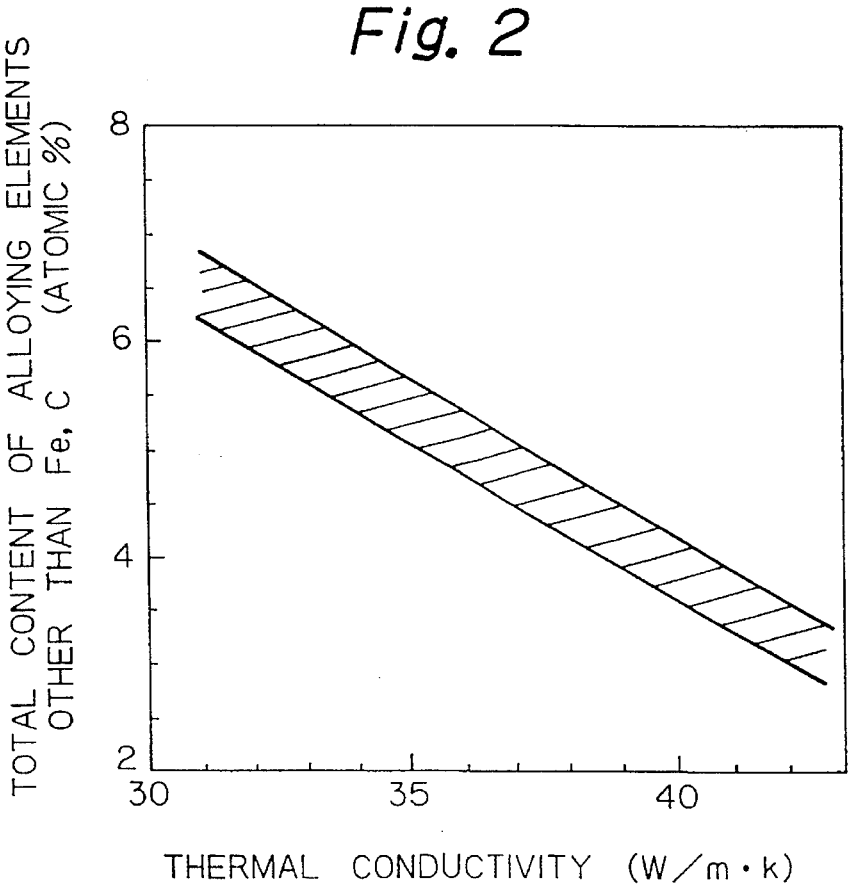
FIG. 2 is a graph showing the relationship between the total content (in atomic %) of elements other than C and Fe, and thermal conductivity.

According to findings made by the present inventor, the thermal conductivity of the alloy steel of the present invention is greatly influenced by the total content of alloying elements other than Fe and C, and there is a stronger relationship between the thermal conductivity and the atomic percentage of these alloying elements, rather than with their weight percentage. Such a relationship can be illustrated as shown in FIG. 2. In this illustrated case, the basic composition conforms to that of Conventional Steel I to which additional alloying elements are added in accordance with the present invention.

The thermal conductivity of a roll shell of the prior art is usually 38–40 W/m.K. When it is below this range, it is recognized that the casting rate must be lowered. For example, when the thermal conductivity of a roll shell is 32 W/m.K, the casting rate is decreased by about 10%. This is unallowable from a practical point of view, even if the resistance to thermal cracking is greatly increased. When it is 35 W/m.K, the decrease in productivity is about 5%, which is an allowable limit from a practical viewpoint. Thus, according to the present invention, the total amount of alloying elements other than Fe and C is restricted to 5.0 atomic % or less on the basis of the data shown in FIG. 2. A preferable total amount is 4.0 atomic % or less.

The present invention will be explained in further detail in conjunction with examples which are presented merely for illustrative purposes and which do not restrict the present invention in any way.

EXAMPLES

Alloy steels having the chemical compositions shown in Table 1 were prepared. The resulting steels included steels of the present invention, comparative steels, and conventional steels. The steels were subjected to forging, annealing, oil-quenching from the temperatures shown in Table 2, and tempering. These processing steps simulated the steps in the manufacture of conventional roll shells. The mechanical properties of these steels were determined after tempering.

Table 2 shows results of a tensile test carried out at room temperature and at 600° C. The temperature of 600° C. is considered the maximum temperature a roll shell reaches during casting. Thus, mechanical properties at 600° C. are critical to the roll shell.

As is apparent from the data shown in Table 2, the steels of the present invention exhibited as high an elongation as the others both at the room temperature and at the elevated temperature, and the yield strength thereof at 600° C. was larger than that of the conventional steels H, I and J.

Comparative Steel C which did not contain Co was inferior to the steels of the present invention with respect to elevated temperature strength and yield strength. This means that the addition of Co is quite effective in the present invention.

Comparative Steel D, which was similar to hot tool steel AISI H10, exhibited more improved yield strength at elevated temperatures than the steel of the present invention. However, this comparative steel contains a relatively high content of alloying elements, resulting in poor thermal conductivity. Thus, this comparative steels is not suitable for making a roll shell.

Table 3 shows the experimental results of the thermal cracking test for the roll shell material of the present invention.

A test piece measuring 30 mm in diameter×5 mm in thickness was heated by high frequency induction heating and was dipped into water at 30° C. This heating and cooling was repeated 5000 times, then the thermal cracking resistance was evaluated by measuring cracks found on a longitudinal cross-section of the test piece. Due to its dimensions the deeper the cracking, the fewer were the cracks. However, resistance to thermal cracking can be rated by the depth of cracking. The higher the elevated temperature yield strength, the shallower were the cracks.

As is apparent from Table 3, the roll shell material of the present invention was superior to the conventional ones with respect to thermal cracking resistance.

Table 4 shows experimental data on thermal conductivity.

It is apparent from the data shown in Table 4 that the thermal conductivity has a close relationship with the total content in atomic % of alloying elements other than Fe and C, and that the roll shell alloy steel of the present invention exhibits excellent thermal conductivity.

On the other hand, the thermal conductivity of Comparative Steel D was lower than the steel of the present invention by 20%, although it exhibited good thermal cracking resistance.

Table 5 shows the test results of continuous sheet casting using a commercial casting machine to compare performance of roll shells of the present invention with that of those made of comparative steels and conventional steels.

The steels shown in Table 5 are not exactly the same, but substantially the same as those shown in Table 1, and they were heat treated in the same manner as those of Table 1. When used in a commercial casting machine, roll shell surfaces are remachined several times to remove thermal cracks formed in the surfaces thereof after each operation lasting for many days. The most important measure of performance of a roll caster shell is the total amount of molten metal which can be cast with the roll shell before it is scrapped due to the total amount of its surface removal reaching the limitation of its usable thickness.

In this example, the roll shell measured 650 mm in diameter and 50 mm in thickness, and it was used until the wall thickness was reduced to 25 mm. Table 5 shows the total amount of aluminum sheets which were produced before the wall thickness of the shell reached 25 mm. The maximum casting speed for pure aluminum is also shown.

It is apparent from the data shown in Table 5 that the roll shell of the present invention can exhibit more successful results than those of conventional steels while maintaining the same casting rate as Conventional Steel H. In the case of Comparative Steel D and Conventional Steel J, productivity was reduced by about 10% and 5%, respectively. This also means that thermal conductivity is critical to a roll shell.

It will be appreciated by those skilled in the art that numerous variations and modifications may be made to the invention as described above with respect to specific embodiments without departing from the spirit or scope of the invention as broadly described.

TABLE 1

| | | Chemical Composition (Weight %) | | | | | | | | | | | |
|---|---|---|---|---|---|---|---|---|---|---|---|---|---|
| | | C | Si | Mn | P | S | Ni | Cr | Mo | V | Co | Fe | Remarks |
| Invention | A | 0.48 | 0.28 | 0.42 | 0.012 | 0.003 | 0.12 | 1.12 | 1.07 | 0.51 | 0.50 | Bal. | |

TABLE 1-continued

| | | Chemical Composition (Weight %) | | | | | | | | | | | |
|---|---|---|---|---|---|---|---|---|---|---|---|---|---|
| | | C | Si | Mn | P | S | Ni | Cr | Mo | V | Co | Fe | Remarks |
| | B | 0.51 | 0.30 | 0.45 | 0.017 | 0.003 | 0.07 | 0.98 | 1.15 | 0.46 | 0.62 | " | |
| Comparative | C | 0.47 | 0.28 | 0.45 | 0.013 | 0.003 | 0.09 | 1.10 | 1.10 | 0.50 | — | " | |
| | D | 0.36 | 0.33 | 0.31 | 0.012 | 0.004 | 0.15 | 2.97 | 2.95 | 0.41 | — | " | Similar to AISI-H10 |
| | E | 0.47 | 0.29 | 0.39 | 0.015 | 0.004 | 0.07 | 1.03 | 0.96 | 0.48 | 0.15 | " | |
| | F | 0.50 | 0.24 | 0.48 | 0.013 | 0.005 | 0.11 | 0.49 | 1.02 | 0.36 | 0.67 | " | |
| | G | 0.49 | 0.30 | 0.47 | 0.012 | 0.004 | 0.12 | 1.20 | 0.52 | 0.43 | 0.58 | " | |
| Conventional | H | 0.56 | 0.29 | 0.47 | 0.015 | 0.005 | 0.44 | 1.13 | 0.53 | 0.12 | — | " | Steel I |
| | I | 0.54 | 0.16 | 0.52 | 0.011 | 0.007 | 0.51 | 2.05 | 0.99 | 0.32 | — | " | Steel II |
| | J | 0.33 | 0.31 | 0.46 | 0.012 | 0.005 | 0.18 | 2.94 | 1.05 | 0.18 | — | " | Steel III |

TABLE 2

| | | Austenitizing Temp. (°C.) | Mechanical Properties at Room Temp. | | | | Mechanical Properties at 600° C. | | | |
|---|---|---|---|---|---|---|---|---|---|---|
| | | | Strength (MPa) | 0.2% Yield Strength (MPa) | Elongation (%) | R.A. (%) | Strength (MPa) | 0.2% Yield Strength (MPa) | Elongation (%) | R.A. (%) |
| Invention | A | 980 | 1530 | 1420 | 14 | 47 | 890 | 760 | 19 | 76 |
| | B | 1010 | 1610 | 1540 | 12 | 44 | 920 | 780 | 18 | 75 |
| Comparative | C | 990 | 1510 | 1350 | 15 | 50 | 820 | 660 | 23 | 81 |
| | D | 1030 | 1600 | 1480 | 11 | 48 | 960 | 805 | 17 | 74 |
| | E | 990 | 1515 | 1360 | 15 | 49 | 830 | 675 | 23 | 79 |
| | F | 980 | 1500 | 1460 | 10 | 35 | 830 | 690 | 20 | 73 |
| | G | 960 | 1490 | 1410 | 14 | 42 | 775 | 630 | 21 | 80 |
| Conventional | H | 950 | 1450 | 1310 | 15 | 38 | 710 | 550 | 25 | 88 |
| | I | 900 | 1570 | 1390 | 14 | 45 | 870 | 715 | 19 | 75 |
| | J | 980 | 1330 | 1140 | 17 | 55 | 820 | 690 | 28 | 82 |

TABLE 3

| | | Thermal Cracking | | |
|---|---|---|---|---|
| | | Number of Cracks | Depth on Average (mm) | Depth at Maximum (mm) |
| Invention | A | 188 | 0.16 | 0.25 |
| | B | 223 | 0.14 | 0.19 |
| Comparative | C | 116 | 0.28 | 0.53 |
| | D | 321 | 0.13 | 0.18 |
| | E | 154 | 0.27 | 0.39 |
| | F | 122 | 0.22 | 0.33 |
| | G | 130 | 0.26 | 0.57 |
| Conventional | H | 135 | 0.26 | 0.64 |
| | I | 157 | 0.19 | 0.39 |
| | J | 194 | 0.19 | 0.34 |

TABLE 4

| | | Thermal Conductivity (W/m · K) | Total Content of Elements other than Fe, C (in atomic %) |
|---|---|---|---|
| Invention | A | 40.7 | 3.96 |
| | B | 40.5 | 3.93 |
| Comparative | C | 41.2 | 3.46 |
| | D | 31.9 | 6.46 |
| | E | 40.5 | 3.37 |
| | F | 41.8 | 3.22 |
| | G | 41.0 | 3.80 |
| Conventional | H | 41.3 | 3.13 |
| | I | 37.8 | 4.45 |
| | J | 34.7 | 5.22 |

TABLE 5

| | | Cast Weight/Used Diameter [ton/mm(diameter)] | Maximum Casting Speed (mm/min) |
|---|---|---|---|
| Invention | Steel B | 9900/25 (=396) | 1050 |
| Comparative | Steel D | 2220/4.5 (=493) | 920 |
| Conventional | Steel H | 3410/25 (=136) | 1070 |
| | Steel J | 8030/25 (=321) | 980 |

What is claimed is:

1. A roll caster shell for use in a continuous, thin plate casting machine which is made of an alloy which consists essentially of, in weight %,:

C: 0.35–0.55%, Si: 0.10–0.50%, Mn: 0.20–0.70%,

P: 0.03% or less, S: 0.02% or less, Ni: 0.60% or less,

Cr: 0.80–1.50%, Mo: 0.80–1.50%, V: 0.30–0.60%,

Co: 0.30–1.00%,

Fe and incidental impurities: balance with the total amount of elements other than Fe and C not exceeding 5.0 atomic %.

2. A roll caster shell as set forth in claim 1 wherein C: 0.45–0.50%.

3. A roll caster shell as set forth in claim 1 wherein Si: 0.15–0.30%.

4. A roll caster shell as set forth in claim 1 wherein Mn: 0.35–0.55%.

5. A roll caster shell as set forth in claim 1 wherein Ni: 0.40% or less.

6. A roll caster shell as set forth in claim 1 wherein Cr: 1.0–1.2%.

7. A roll caster shell as set forth in claim 1 wherein Mo: 1.0–1.2%.

8. A roll caster shell as set forth in claim 1 wherein V: 0.40–0.60%.

9. A roll caster shell as set forth in claim 1 wherein Co: 0.40–0.60%.

10. A roll caster shell as set forth in claim 1 wherein the roll shell is used for continuous casting of aluminum.

11. A roll caster shell for use in a continuous sheet casting machine which is made of an alloy which consists essentially of, in weight %,:

C: 0.45–0.50%, Si: 0.15–0.30%, Mn: 0.35–0.55%,

P: 0.03% or less, S: 0.02% or less, Ni: 0.40% or less,

Cr: 1.0–1.2%, Mo: 1.0–1.2%, V: 0.40–0.60%,

Co: 0.30–1.00%,

Fe and incidental impurities: balance with the total amount of elements other than Fe and C not exceeding 5.0 atomic %.

12. A roll caster shell as set forth in claim 11 wherein Co: 0.40–0.60%.

13. A roll caster shell as set forth in claim 11 the total amount of elements other than Fe and C does not exceed 4.0 atomic %.

14. A roll caster shell as set forth in claim 11 wherein the roll shell is used for continuous casting of aluminum.

* * * * *